United States Patent [19]

Codenotti

[11] Patent Number: 4,683,664

[45] Date of Patent: Aug. 4, 1987

[54] APPARATUS FOR DRYING METAL TURNINGS OR SCRAP

[76] Inventor: Giovanni Codenotti, Via Galli No. 7, Gussago, Brescia, Italy, 25064

[21] Appl. No.: 670,752

[22] Filed: Nov. 13, 1984

[30] Foreign Application Priority Data

Dec. 12, 1983 [IT] Italy ..... 5232 A/83
Dec. 30, 1983 [GB] United Kingdom ..... 8334622

[51] Int. Cl.[4] ..... F26B 3/24

[52] U.S. Cl. ..... 34/35; 34/36; 34/86; 34/126; 34/130; 34/136; 432/72; 432/112; 432/198

[58] Field of Search ..... 34/63, 86, 126, 130, 34/135, 136, 137, 139, 36, 35; 432/72, 112, 116, 198; 431/5, 284

[56] References Cited

U.S. PATENT DOCUMENTS

| | | | |
|---|---|---|---|
| 2,400,935 | 5/1946 | Kent | 34/63 |
| 3,013,785 | 12/1961 | King | 34/135 |
| 3,302,937 | 2/1967 | Pixley | 34/63 |
| 3,619,907 | 11/1971 | Kallas | 34/63 |
| 3,762,858 | 10/1973 | Torrence | 432/72 |
| 3,817,697 | 6/1974 | Parobek | 432/72 |
| 4,021,192 | 5/1977 | Ferguson | 432/72 |
| 4,201,370 | 5/1980 | Evans et al. | 432/72 |
| 4,260,373 | 4/1981 | Fellnor et al. | 34/135 |
| 4,370,357 | 1/1983 | Swartz | 34/36 |
| 4,494,317 | 1/1985 | Biagi et al. | 34/73 |

FOREIGN PATENT DOCUMENTS

| | | |
|---|---|---|
| 825628 | 12/1959 | United Kingdom . |
| 1250962 | 10/1971 | United Kingdom . |
| 1372707 | 11/1974 | United Kingdom . |
| 2033065 | 5/1980 | United Kingdom . |

*Primary Examiner*—Albert J. Makay
*Assistant Examiner*—David W. Westphal
*Attorney, Agent, or Firm*—Charles E. Brown; Charles A. Brown

[57] ABSTRACT

Apparatus for the drying of ferrous or non-ferrous turnings or scrap comprises a vertical axis drier (1) in which a drum (2) which encloses a transporter (3) for the turnings in question is mounted transversely. The turnings are heated indirectly via the drum (2) to evaporate their liquid content, while a protective atmosphere is maintained within the drum to prevent oxidation of the material. The vapors leaving the drum (2) are burnt in the drier (1) to heat the material and render the operation of the apparatus self-sufficient. As an alternative the vapors can be treated to recover their oil content, e.g. by distillation.

6 Claims, 5 Drawing Figures

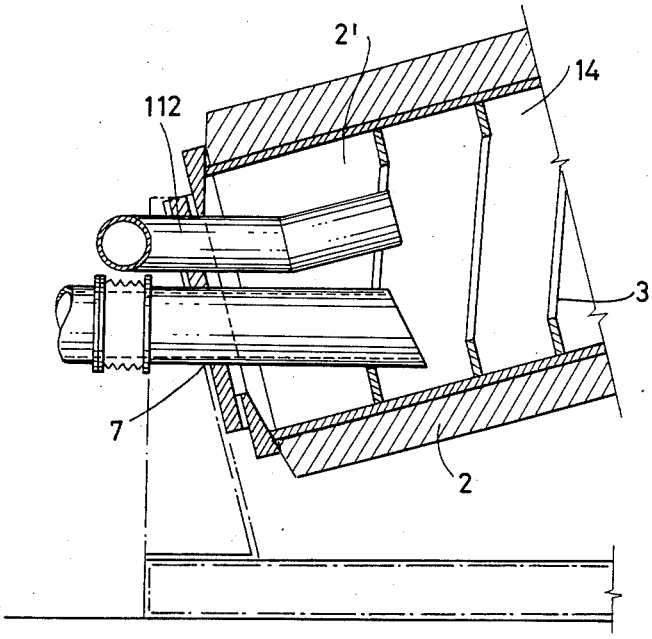
Fig. 3
Fig. 4
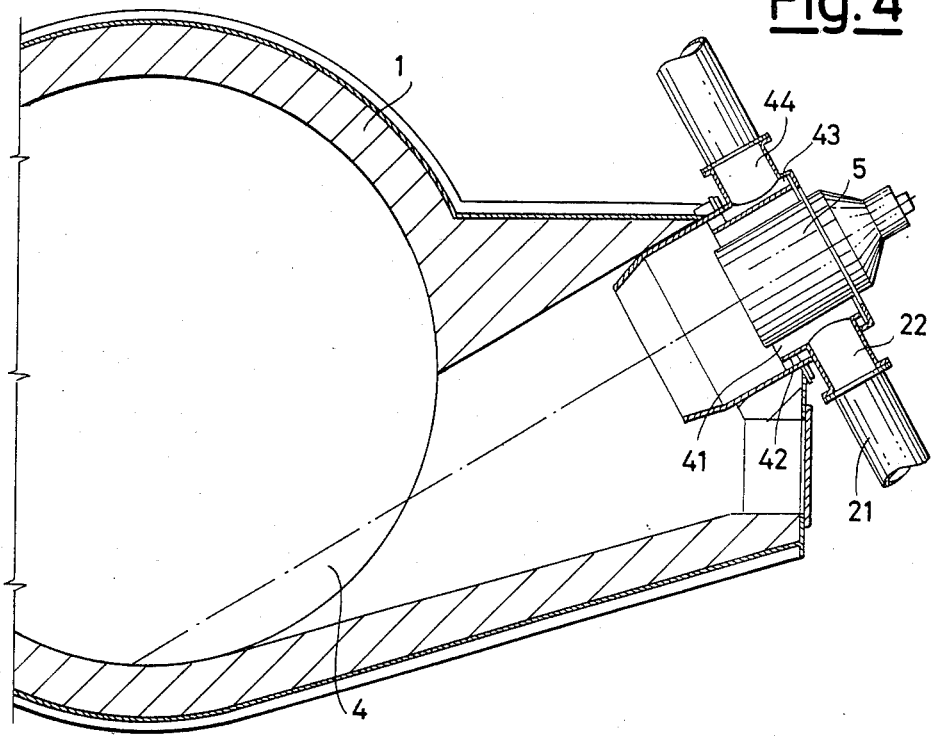

APPARATUS FOR DRYING METAL TURNINGS OR SCRAP

BACKGROUND OF THE INVENTION

The present invention relates to equipment for the drying of metal turnings or scrap prior to such being used in melting furnaces.

Metal turnings, both ferrous and non-ferrous, must be dried in order to remove their liquid content before they are used in melting furnaces. In fact turnings from machine tools always contain liquid of the order of 3–5% on average and comprising the residues of cutting oils or coolants, solvents, additives, water, etc. If these liquids are not removed in advance they tend to cause agglomerations or clumping when the turnings are loaded into melting furnaces and to form compact layers on the surface of the molten metal. The gases which are produced by the presence of such liquids also tend to give rise to explosions, flare-ups and toxic fumes, and when in contact with the metal they give rise to the formation of oxides and slag with a consequent loss of metal.

It has been found that the loss of metal on melting is directly proportional to the liquid content of the initial turnings. An investigation based on many fusion tests with brass turnings has shown that there is a loss of about 30% of molten metal when the initial turnings have a high liquid content, against a loss of 2–3% when dried turnings are used. Various apparatus have already been proposed in which the material which is to be dried is passed into a drier and heated directly by a heat source which burns a combustible gas, and these apparatus for the drying of material such as turnings, in addition to processing involving washing with solvents, centrifugation, etc., have nevertheless in the main proved themselves to be sources of waste and pollution. When the material is heated the liquids contained within it evaporate and therefore form vapors. Some of these burn in the drier when in contact with the flames used to heat the material while the remainder are collected and passed out of the drier where they are normally burnt in another afterburner using another fuel.

Units of this type are rather complex and cumbersome and involve both a high energy consumption, and thus high operating costs, partly because they are not able to utilize the calorific content of the vapors produced, which is high, and also require apparatus for cooling and filtering of the fumes before they are discharged to the atmosphere in order to prevent pollution. The afterburner also frequenly clogs up as a result of the dust carried by the fumes and requires periodical shut-downs to permit cleaning to be effected.

To be specific, apparatus of the known type are, in addition to having inconveniences and disadavantages in operation, rather complex and cumbersome and normally require special foundations or in any event require masonry structures which place a large burden on the costs of the units in addition to high operating costs.

SUMMARY OF THE INVENTION

According to the present invention, there is provided apparatus for the drying of ferrous or non-ferrous turnings or scrap before they are used in a melting-down furnace, comprising a drier or furnace in which a drum enclosing a transporter for the material is mounted transversely and wherein the material is heated indirectly via said drum by means of a burner device mounted in the drier to evaporate the liquid contents of the material, while an inert gas is passed into the drum to maintain a protective atmosphere to prevent oxidation of the material, and wherein the vapors which are produced in the said drum are passed to the drier or furnace and burnt there to heat the material which is moving in the drum, the material which is to be dried being moved in the drum in a counter-current or co-current direction with respect to the movement of the combustion products.

The apparatus thus comprises a vertical axis furnace or drier in which a rotating drum is mounted transversely and incorporates a transporter for forward movement of the material, in particular ferrous or non-ferrous turnings, which is to be dried. The material is heated indirectly by the drum, in a counter-current or co-current fashion, in order to evaporate its liquid content, while a protective atmosphere is constantly maintained within the drum through the injection of an inert gas to prevent oxidation of the material. The vapors leaving the drum are passed into the drier and are burnt there to heat the material passing through the drum and render the operaton of the unit selfsufficient.

As an alternative the vapors leaving the drum can be treated to recover their oil content, e.g. by distillation.

It is also an object of the present invention to provide an apparatus for the drying of metal turnings or scrap in which provision is made for the afterburning of the fumes or vapors, when they leave the drum through which the material passes, which afterburning is brought about directly within the drier or furnace through the use of the vapors instead of a fuel in order to heat the material which is to be dried.

Another object of the present invention is to provide an apparatus which uses a single burner and in which fume filtering devices can be reduced, if not done away with, with the advantage of greater simplicity and a reduction in both the cost and the operating and maintenance costs of the apparatus.

Another object of this invention is to provide an apparatus which comprises a drum/transporter which can be inclined upwards in order to assist the fumes or vapors produced when the material is dried to escape and to simplify both the addition and removal of material from the transporter drum, avoiding the need for lifting gear at the inlet and outlet of the said drum. This does not however rule out the possibility that the drum and the transporter included within it may be arranged horizontally or may be inclined downwards towards the outlet for the material while remaining within the scope of the invention.

BRIEF DESCRIPTION OF THE DRAWINGS

FIG. 3 is a cross-sectional detail of the drum in the vicinity of the inlet for the material and inert gas to maintain a protective atmosphere within the drum itself;

FIG. 4 is a cross-section of the burner of the drier or furnace; and

DESCRIPTION OF THE PREFERRED EMBODIMENTS

Figure 1:
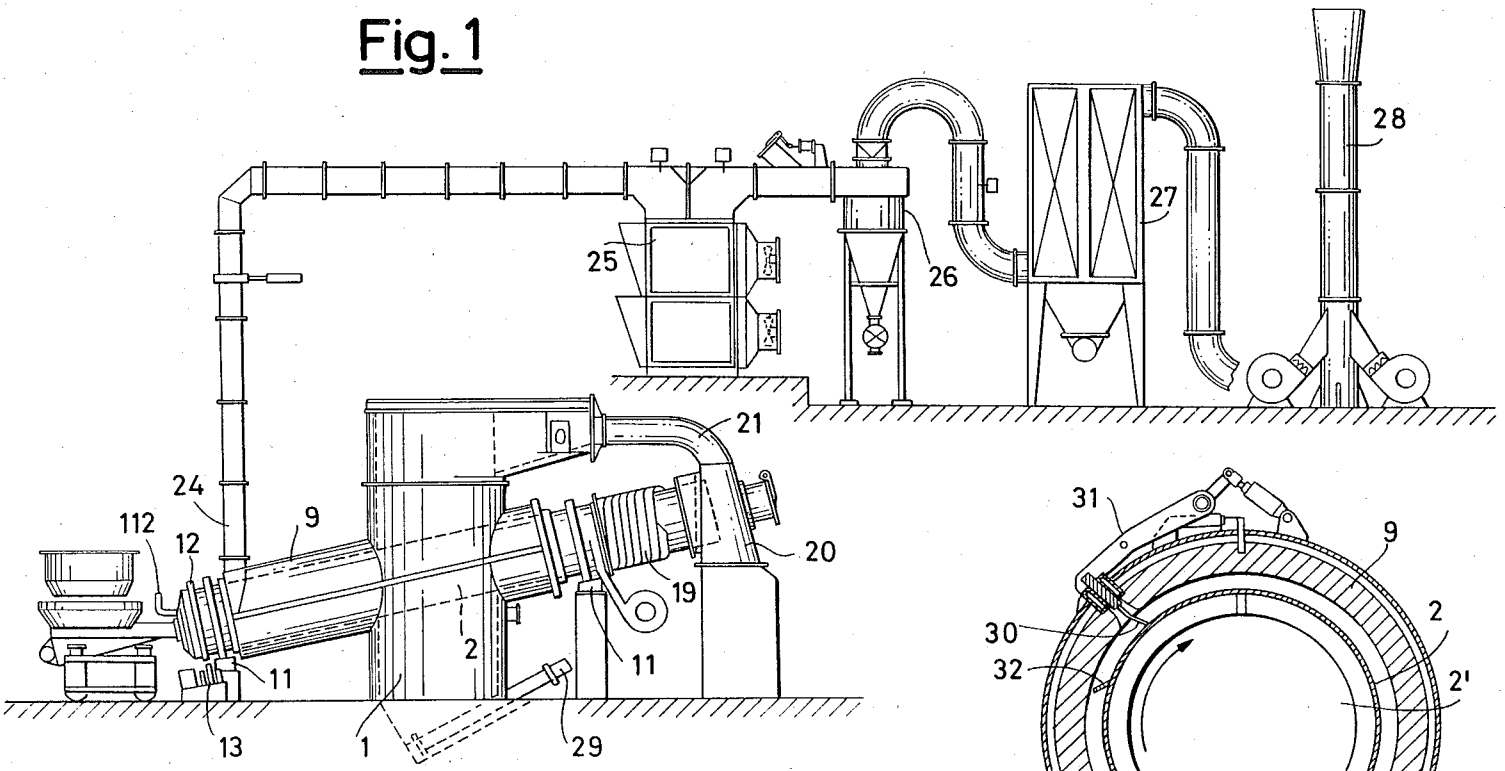
FIG. 1 is a schematic elevation illustrating the drying apparatus.

A drier or furnace 1 is illustrated in which there is transversely mounted a drum 2 which encloses a transporter 3 for forward movement of the material which is to be dried.

The drier or furnace 1 defines a chamber 4 of a cylindrical or other shape having a vertical axis and has at its top a gas burner 5 which is mounted tangentially. The bottom 6 of chamber 4 may be flat or preferably in the shape of a hopper.

The drum 2 may be arranged with its axis inclined upwards from its inlet 7 for the loading of the material which is to be dried and extends upwardly to its end 8 from which the dried material and the fumes or vapors produced during drying escape.

Drum 2 extends concentrically in a tubular portion 9 provided in the shell 3 of the drier and across and on either side of chamber 4.

Drum 2 may be rotatable and in which case its two parts rest on supporting bearings 11 on opposite sides of the drier 1 and the drum 2 is rotatably driven by a chain drive 12 driven by a motor/reduction gear 13.

The transporter 3 for the material may be constructed of a coiled strip or a screw plate which advances in the form of a screw 14 fixed to the internal surface of drum 2 over its entire length for movement of the material from the loading inlet 7 to the end of the drum 8 where the dried material is discharged.

The inclination of drum 2 and transporter 3 within it favors separation of the fumes or vapors from the material which is being dried, and escape of the vapors from drum 2.

Figure 2:
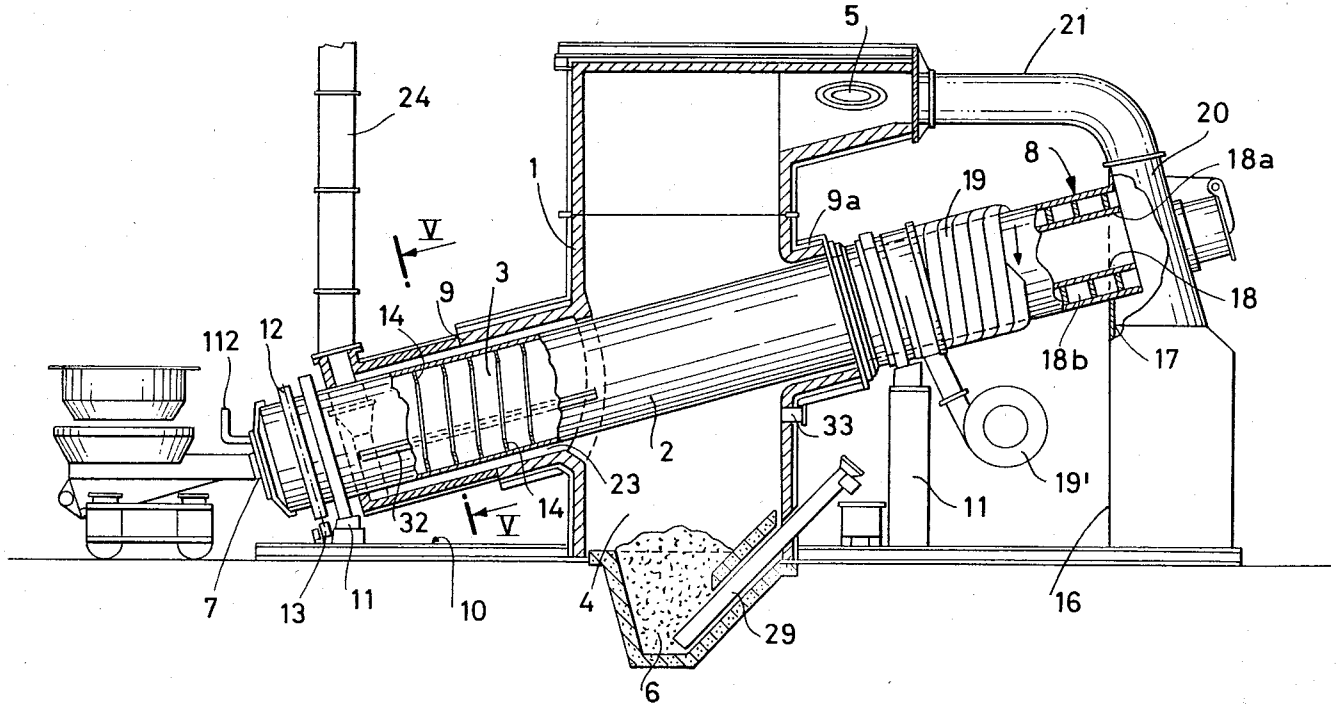
FIG. 2 is a vertical section through a drier and drum which extends within it.

This separation between fumes and vapors and materials is assisted and virtually ensured by means of a sleeve 17 which is fixed to the summit of the last turn of the screw transporter 14 within drum 2 (see FIG. 2). This sleeve 17 together with drum 2 bounds a longitudinal annular passage for the material and axially a duct 18 for fumes and vapors only. This helps to maintain the temperature of the fumes or vapors almost unchanged and on the other hand can cool the material before it is discharged from drum 2 to collector device 16.

In order to achieve this cooling of the material, the latter part of drum 2 may be surrounded by a coil heat exchanger 19 through which cooling air circulates and which ends in an aspirator 19'.

The cooling air is circulated counter-currently with respect to the material and the hot air leaving the exchanger 19 can advantageously be used for the air supply to burner 5 operating within drier 1.

Although the inclined arrangement of drum 2 and transporter 3 within it is apparently the most advantageous, this does not however rule out the possibility that drum 2 might for some reason be mounted horizontally or inclined downwards towards the discharge region for the material, and the drum itself may be stationary or vibrating, without going beyond the scope of the invention. Similarly transporter 3 may comprise a conveyor belt or a roller plane (not shown) instead of the screw plate.

In any event inert gas is passed into the chamber 2' defined by the rotating drum 2 in order to maintain a protective atmosphere within the drum and to prevent oxidation of the material which is being dried. The injection of inert gas into chamber 2' of drum 2 may be achieved e.g. by means of an injector 112 which is aligned with the said drum at the material inlet 7 - see FIG. 3.

The opposite end 8 of drum 2 is on the other hand provided with a suction hood 20 to collect the fumes or vapors which separate from the material being dried. The hood 20 is connected by means of a pipe 21 to the top of the drier or furnace in order to pass the fumes or vapors into it. The inlet 22 (FIG. 4) for the fumes or vapor into the drier is provided in or adjacent to the region in which fuel burner 5 is in operation so that the flame from the latter can also initiate combustion of the said fumes or vapors.

Advantageously the fumes or vapors are passed via pipe 21 (see FIG. 4) into an annular chamber 41 surrounding the body of burner 5 and bounded by a sleeve 42. A second annular chamber 43 is provided concentrically outside annular chamber 41 and into this there flows the air for combusion, which may, for example, be the air leaving heat exchanger 19 mentioned above, via an opening 44. A system of this kind makes it possible to use fuel burner 5 to start up the apparatus until the drying process is established and fumes or vapors are being produced in the drum.

When the flow of such fumes or vapors to the drier is regular and sufficient they are ignited, the fuel supplying burner 5 is reduced to the flow required to keep the pilot flame of said burner alight. All the heat required by the process is then provided exclusively by combustion of the fumes or vapor derived from the drying of the material.

In practice the hot vapors which are produced initially by the burning of fuel in the burner and subsequently by burning of the vapors which are released during drying of the material and leave the drum pass over the external surface of drum 2 and pass along a passage 23 provided between the rotating drum and tubular portion 9 and are discharged via a pipe 24 placed near to the mouth 7 of the drum. In the example shown the transfer of heat between the fumes and the material which is to be dried occurs counter-currently and indirectly via the drum, without any direct contact between the products of combustion and the material. The material and the vapors which are released in the drum are thus protected against contact with the flames, and as a result of the atmosphere of inert gas which is produced within the drum chamber, the material is not subjected to oxidation.

The fumes which flow out through pipe 24 are then passed (see FIG. 1) into a heat exchanger 25 which reduces their temperature to the required value and then to a cyclone 26 for precipitation of the dust and then finally, but only if necessary, into a bag filter 27 before being discharged to the atmosphere via a stack 28 which acts in association with all the blowers driving the circulation of gases within the unit.

The simplicity and the functional capacities of the apparatus and the possibility of profitably and advantageously using the fumes or vapors originating from the drying of the material as a fuel for direct use in the drier flow from what has been said above. The material is also treated in a closed chamber, separate from the products of combusion, which makes it possible to maintain a protective atmosphere which prevents oxidation of the material and reduces the loss of metal when it is melted in melting-down furnaces.

The apparatus described can be provided with other devices which make it even more functionally effective and advantageous.

One of these devices comprises the hopper bottom 6 which is provided as mentioned above in the bottom of chamber 4 of the drier. As a result of the vertical arrangement of chamber 4 the dust and solid particles circulating within the drier can settle out into this hopper bottom 6 from which they can be removed at intervals by means of a transporter 29 fitted there (see FIG. 2). This makes it possible to keep the drier adequately clean without the need for the unit to be shut down for direct access by operators.

Figure 5:
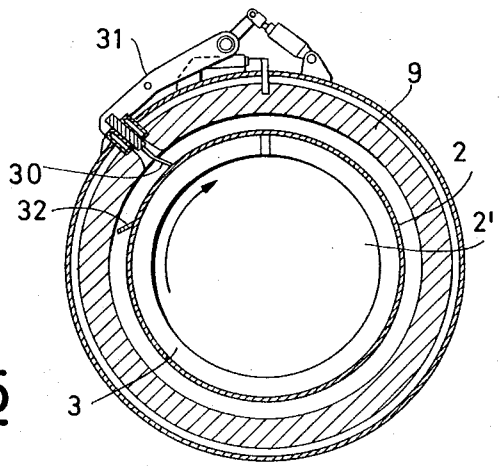
FIG. 5 is a transverse cross-section along the line indicated by arrows V—V in FIG. 2.

Within the tubular portion 9 in which drum 2 is mounted, a scraper 30 is mounted in order to act upon the external surface of the drum and keep it free from solid deposits. This scraper 30 is, for example, mounted on arms 31 so that it can be moved and positioned radially with respect to the drum (see FIG. 5). A fixed scraper 32 on the other hand is mounted on the surface of drum 2 and this when it rotates with the drum removes solid deposits from the internal surface of the tubular portion in order to keep passage 23 clear for the fumes which are directed towards the discharge pipe 24.

Finally a cold air intake with a controlled aperture is mounted on the shell 3 of the drier in order to prevent overheating of the drier.

It should be noted that the vapors leaving the drum, or at least some of them, can be treated to recover cooling oil and/or other components using suitable distallation or like processes.

What is claimed is:

1. Apparatus for drying solid waste and scrap material to remove liquid contaminants therefrom, comprising the combination of a drum having an inlet end for receiving material containing liquid contaminants and an outlet end for discharging the decontaminated material, a transporter for moving the material lengthwise of the drum from its inlet end to its outlet end, the drum having an impervious side wall to shield the material passing therethrough from atmosphere outside the drum, a furnace through which the drum passes, the furnace having a gas burner for directing hot burning gases against the side wall of the drum to heat the material passing therethrough, and means for injecting into the drum an inert gas to maintain a protective atmosphere within the drum to prevent oxidation of the material, the drum and the transporter being inclined upwards from said inlet end to said outlet end; the upper end of said drum being connected by a pipe to a drier in order to pass fumes and vapors which are to be burnt into said drier, the drum extending on either side of the drier in a tubular portion which encloses at least the lower part of said drum, and in which said drier has a vertical axis and a hopper bottom for collection of dust and is provided with a transporter for the removal of such dust.

2. Apparatus for drying solid waste and scrap material to remove liquid contaminants therefrom, comprising the combination of a drum having an inlet end for receiving material containing liquid contaminants and an outlet end for discharging the decontaminated material, a transporter for moving the material lengthwise of the drum from its inlet end to its outlet end, the drum having an impervious side wall to shield the material passing therethrough from atmosphere outside the drum, a furnace through which the drum passes, the furnace having a gas burner for directing hot burning gases against the side wall of the drum to heat the material passing therethrough, and means for injecting into the drum an inert gas to maintain a protective atmosphere within the drum to prevent oxidation of the material, the drum and the transporter being inclined upwards from said inlet end to said outlet end; the upper end of said drum being connected by a pipe to a drier in order to pass fumes and vapors which are to be burnt into said drier, an air-flow external coil heat exchanger being provided in the vicinity of the upper end of said drum in order to exchange heat with the material and cool the material before the material is discharged from the drum/transporter and a sleeve secured within said drum bounding an axial duct for separation of the fumes and vapors from the material.

3. Apparatus for drying solid waste and scrap material to remove liquid contaminants therefrom, comprising the combination of a drum having an inlet end for receiving material containing liquid contaminants and an outlet end for discharging the decontaminated material, a transporter for moving the material lengthwise of the drum from its inlet end to its outlet end, the drum having an impervious side wall to shield the material passing therethrough from atmosphere outside the drum, a furnace through which the drum passes, the furnace having a gas burner for directing hot burning gases against the side wall of the drum to heat the material passing therethrough, and means of injecting into the drum an inert gas to maintain a protective atmosphere within the drum to prevent oxidation of the material, the burner being constructed to burn either a combustible gas or vapors leaving the drum, said burner comprising a gas burner having a pilot surrounded by a first annular chamber into which the vapors which are to be burnt are fed and a second annular chamber into which the air for combustion flows, the gas flow being reduced to that of the pilot after combustion of the vapors has been initiated.

4. Apparatus for drying solid waste and scrap material to remove liquid contaminants therefrom, comprising the combination of a drum having an inlet end for receiving material containing liquid contaminants and an outlet end for discharging the decontaminated material, a transporter for moving the material lengthwise of the drum from its inlet end to its outlet end, the drum having an impervious side wall to shield the material passing therethrough from atmosphere outside the drum, a furnace through which the drum passes, the furnace having a gas burner for directing hot burning gases against the side wall of the drum to heat the material passing therethrough, means for injecting into the drum an inert gas to maintain a protective atmosphere within the drum to prevent oxidation of the material, and means for conducting from the outlet end of the drum to the gas burner the vapors formed as the liquid contaminants evaporate from the material to be ignited at the gas burner for heating the material passing through the drum.

5. The apparatus of claim 4 wherein said apparatus is particularly adapted for drying metal turnings to remove liquid content of cutting oils, coolings, solvents and the like.

6. The method of drying solid waste and scrap material comprising moving the material internally of a container having a side wall adapting to exclude from the material external atmosphere and oxygen containing gases, applying burned vapors to the container externally thereof to heat the material coursing through the container to evaporate liquids from the material into vapors, introducing an inert gas into the container to maintain a protective atmosphere against oxidation of the material and to absorb vapors evaporated from the material, conducting the vapors out of said container and away from the material, and burning the vapors conducted out of said container for application externally of the container whereby the caloric value of the liquids is utilized to produce usable heat.

* * * * *